US005746703A

United States Patent [19]

Levatino

[11] Patent Number: 5,746,703

[45] Date of Patent: May 5, 1998

[54] TEMPOROMANDIBULAR REHABILITATOR

[76] Inventor: Samuel R. Levatino, 3608 Woodland Ridge Blvd., Baton Rouge, La. 70816

[21] Appl. No.: 701,803

[22] Filed: Aug. 26, 1996

[51] Int. Cl.[6] ..... A63B 23/03

[52] U.S. Cl. ..... 601/38; 482/11; 482/121

[58] Field of Search ..... 482/11, 44, 49, 482/121, 139; 601/38; 128/777, 859, 861, 862; 73/379.01, 379.02; 433/6, 7, 18, 19; D24/180, 182

[56] References Cited

U.S. PATENT DOCUMENTS

| | | | |
|---|---|---|---|
| 1,363,534 | 12/1920 | Rogers . | |
| 1,576,602 | 3/1926 | Haims | 482/49 |
| 1,714,029 | 5/1929 | Kuhn . | |
| 2,202,202 | 5/1940 | Hesse | 482/47 |
| 2,556,639 | 6/1951 | Wimberly | D24/182 |
| 3,813,096 | 5/1974 | Welch . | |
| 4,280,696 | 7/1981 | Ramon . | |
| 4,883,046 | 11/1989 | Fontenot . | |
| 4,955,367 | 9/1990 | Homsy . | |
| 5,035,420 | 7/1991 | Beeuwkes, III et al. . | |

FOREIGN PATENT DOCUMENTS

| | | | |
|---|---|---|---|
| 2322077 | 12/1973 | Germany | 482/11 |
| 6339546 | 12/1994 | Japan | 482/47 |
| 2260500 | 4/1993 | United Kingdom | 482/11 |

*Primary Examiner*—Jeanne M. Clark
*Attorney, Agent, or Firm*—Reginald F. Roberts, Jr.

[57] ABSTRACT

A temporomandibular rehabilitator having (a) a lower planar member having a longitudinal center, first and second ends, and a segment connecting the first and second ends to one another; and (b) an upper angular member having first and second ends, and first and second planar faces having an obtuse interior angle between the faces. The angular member is pivotally connected at the vertex of the obtuse interior angle to the segment of the planar member which connects the first and second ends of the planar member to one another, so that the first planar face of the angular member can be brought into parallel contact with the first end and with a first portion of the segment connecting the first and second ends of the planar member to one another, or the second planar face of the angular member can be brought into parallel contact with the second end and with a second portion of the segment connecting the first and second ends of the planar member to one another. The rehabilitator includes a mechanism for forcing the first planar face of the angular member apart from the first end and first portion of the segment connecting the first and second ends to one another, and a mechanism for controlling the extent to which the first planar face of the angular member is forced apart from the first end and first portion of the segment connecting the first and second ends of the planar member to one another.

3 Claims, 3 Drawing Sheets

TEMPOROMANDIBULAR REHABILITATOR

BACKGROUND OF THE INVENTION

The present invention relates to physical therapy. More particularly, the present invention relates to a mechanical device for facilitating an increased range of motion for the mandible, and for relieving chronically-spasmed muscles of mastication.

It is known by those skilled in the art that certain facial muscles are ordinarily used very little, and therefore tend to become soft and subject to muscle spasms. Exercise of jaw muscles is an important part of treatment and rehabilitation for many jaw injuries and disorders.

The lower jaw is made of just one bone, known as the mandible. The mandibular elevators, which close the lower jaw, include the coordinated function of the masseter, temporal, and medial pterygoid muscles. The mandibular depressors which open the lower jaw include the activity of the external pterygoid and the suprahyoid muscles. Protrusion of the mandible is performed by the masseter, internal ptyerygoid, and external pterygoid muscles. Retrusion of the mandible is accomplished by the temporal and dijastic muscles.

Mandibular jaw closure depends upon the functional integrity of a group of muscles which perform their functions simultaneously. The smooth functioning of these muscles is essential for the proper occlusion of the teeth. When these muscles and surrounding tissues are impaired due to injury or surgery, disclusion or malocclusion of the teeth often takes place.

Repetetive and rhythmic opening and closing of the mandible, if properly administered, can induce strains within the oral tissue and surrounding structures which result in enhanced healing and rapid pain reduction or suppression, thereby facilitating and accelerating the complete healing of the tissue structures of the oral cavity to the point that the healed structure can properly and adequately perform its specific function, and can contribute to the overall function of the oral cavity as well as of the total temporomandibular joint.

SUMMARY OF THE INVENTION

In general, the present invention provides a temporomandibular rehabilitator comprising (a) a lower planar member having a longitudinal center, first and second ends, and a segment connecting the first and second ends to one another; and (b) an upper angular member having first and second ends, and first and second planar faces defining an obtuse interior angle therebetween. The angular member is pivotally connected at the vertex of the obtuse interior angle to the segment of the planar member which connects the first and second ends thereof to one another, whereby the first planar face of the angular member can be brought into parallel contact with the first end and with a first portion of the segment connecting the first and second ends of the planar member to one another, or the second planar face of the angular member can be brought into parallel contact with the second end and with a second portion of the segment connecting the first and second ends of the planar member to one another. The rehabilitator further comprises biasing means for forcing the first planar face of the angular member apart from the first end and first portion of the segment connecting the first and second ends to one another.

DETAILED DESCRIPTION OF THE INVENTION

Figure 1:
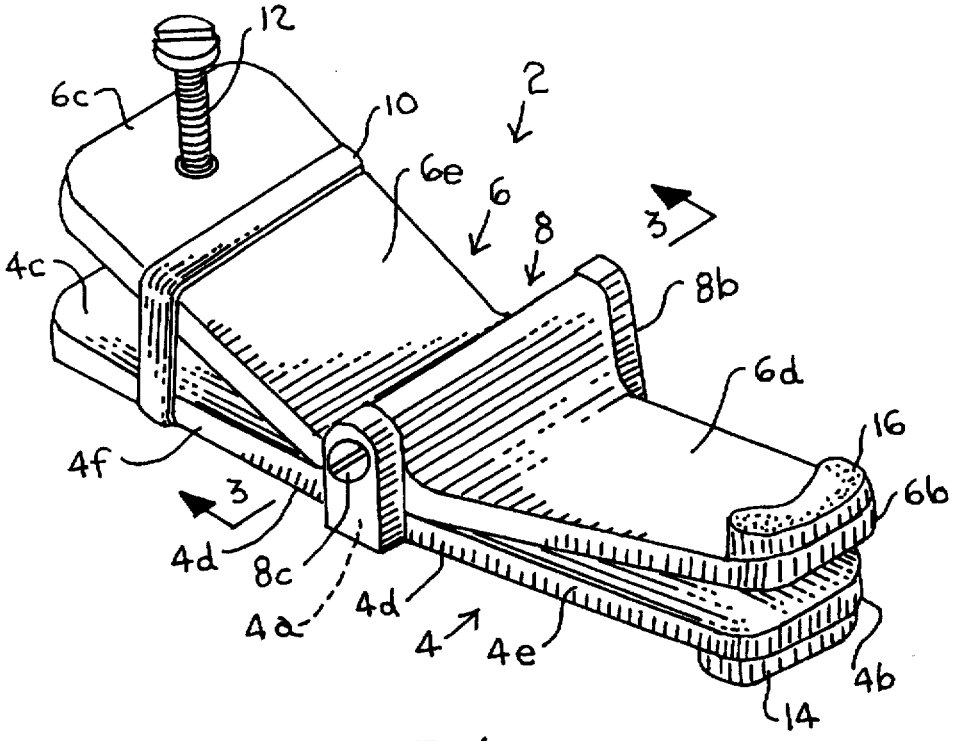
FIG. 1 is an isometric view of a first embodiment of a temporomandibular rehabilitator, made in accordance with the principles of the present invention, in a first configuration.
Figure 2:
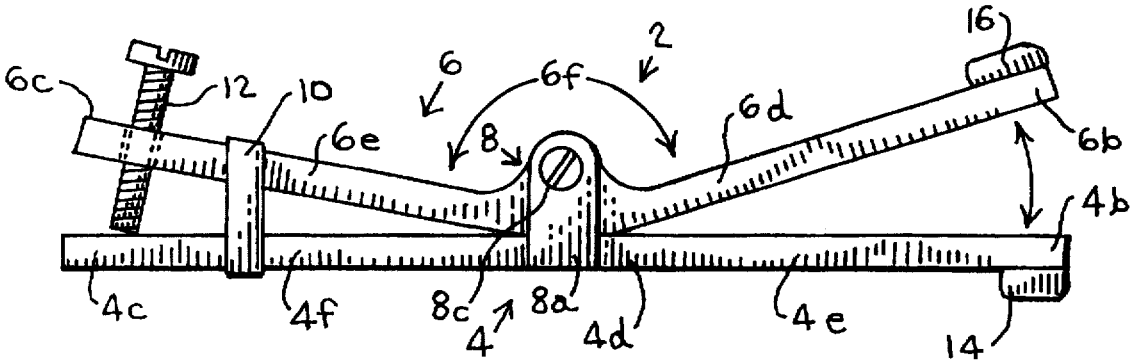
FIG. 2 is an isometric view of the temporomandibular rehabilitator shown in FIG. 1, in a second configuration.
Figure 3:
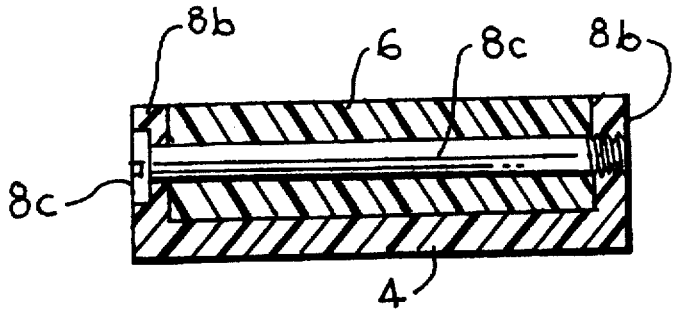
FIG. 3 is a cross-sectional view of the temporomandibular rehabilitator shown in FIG. 1, taken along the cutting line 3—3.

More specifically, reference is made to FIGS. 1–3 and 5, in which is shown a first embodiment of a temporomandibular rehabilitator, made in accordance with the principles of the present invention, and generally designated by the numeral 2.

The temporomandibular rehabilitator 2 comprises a lower planar member 4 having a longitudinal center **4*a*, a first end 4*b*, a second end 4*c*, and a segment 4*d* connecting the first and second ends 4*b* and 4*c*** to one another.

The temporomandibular rehabilitator 2 further comprises an upper angular member 6 having a first end **6*b*, a second end 6*c*, a first planar face 6*d*, and a second planar face 6*e*. The first and second planar faces 6*d* and 6*e* define therebetween an obtuse interior angle 6*f***.

The angular member 6 is pivotally connected at the vertex of the obtuse interior angle **6*f* to the segment 4*d* which connects the first and second ends 4*b* and 4*c* of the planar member 4 to one another. The pivotal connection is effected by means of a hinge mechanism 8 comprising first and second posts 8*a* and 8*b*, and a hinge pin 8*c* disposed in and connecting the first and second posts 8*a* and 8*b* to one another. The first and second posts 8*a* and 8*b* are fastened to or integral with the upper and lower members 4 and 6**.

The temporomandibular rehabilitator 2 includes elastic biasing means 10 for forcing the first planar face **6*d* of the angular member 6 apart from the first end 4*b* and a first portion 4*e* of the segment 4*d* connecting the first and second ends 4*b* and 4*c* of the planar member 4** to one another.

A very important feature of the present invention is a set screw 12 which controls the extent to which the first planar face **6*d* of the angular member 6 is forced apart from the first end 4*b* and first portion 4*e* of the segment 4*d* connecting the first and second ends 4*b* and 4*c* of the planar member 4** to one another. In the absence of such control serious injury to the jaw and/or jaw muscles of the user could result.

Figure 5:
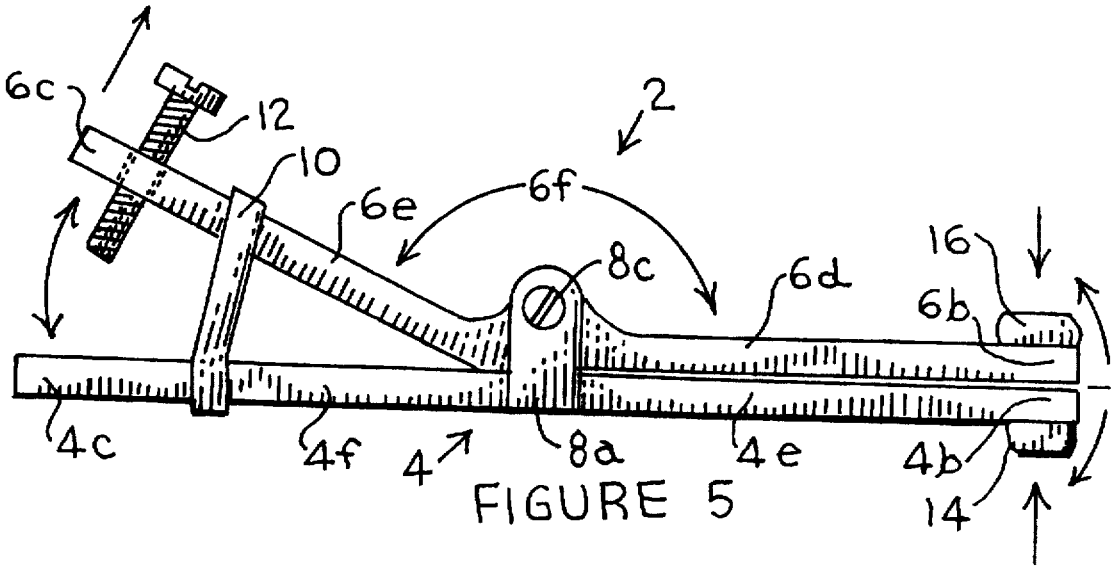
FIG. 5 is an isometric view of the temporomandibular rehabilitator shown in FIGS. 1–4, in a third configuration.

As shown in FIG. 5, the first planar face **6*d* can be brought into parallel contact with the first portion 4*e* of the connecting segment 4*d*. Similarly, by "backing off" the set screw 12, the second planar face 6e can be brought into parallel contact with a second portion 4*f* of the connecting segment 4*d*. These operations represent extreme and limiting positions and configurations of the temporomandibular rehabilitator 2**.

A first strip 16 of a soft and resilient material is attached to the upper surface of the first end **6*b* of the upper angular member 6, for the upper teeth to rest upon. A second strip 14 of a soft and resilient material is attached to the lower surface of the first end 4*b* of the lower planar member 4**, for the lower teeth to rest upon.

The magnitude of the obtuse interior angle 4f is preferably from about one hundred to about one hundred and seventy degrees, and even more preferably from about one hundred and fifty to about one hundred and sixty degrees.

The maximum distance separating the first ends 4b and 6b of the planar and angular members 4 and 6 when the first planar face 6d of the angular member 6 is forced apart from the first end 4b of the planar member 4 is preferably from about forty to about sixty millimeters.

The length of the upper and lower members 6 and 4 is preferably from about seven to about nine inches. The width of the upper and lower members 6 and 4 is preferably from about two and two-tenths to about two and six-tenths inches.

The upper angular member 6 and the lower planar member 4 are preferably made of plastic. The first and second strips 16 and 14 of soft and resilient material are preferably made of rubber, and are preferably attached to the upper and lower members 6 and 4 by adhesive or clip-on means (not shown).

Preferably, the angular member 6 is pivotally connected to the planar member 4 near the longitudinal center 4a of the planar member 4. Even more preferably, the angular member 6 is pivotally connected to the planar member 4 at the longitudinal center 4a of the planar member 4.

Figure 4:
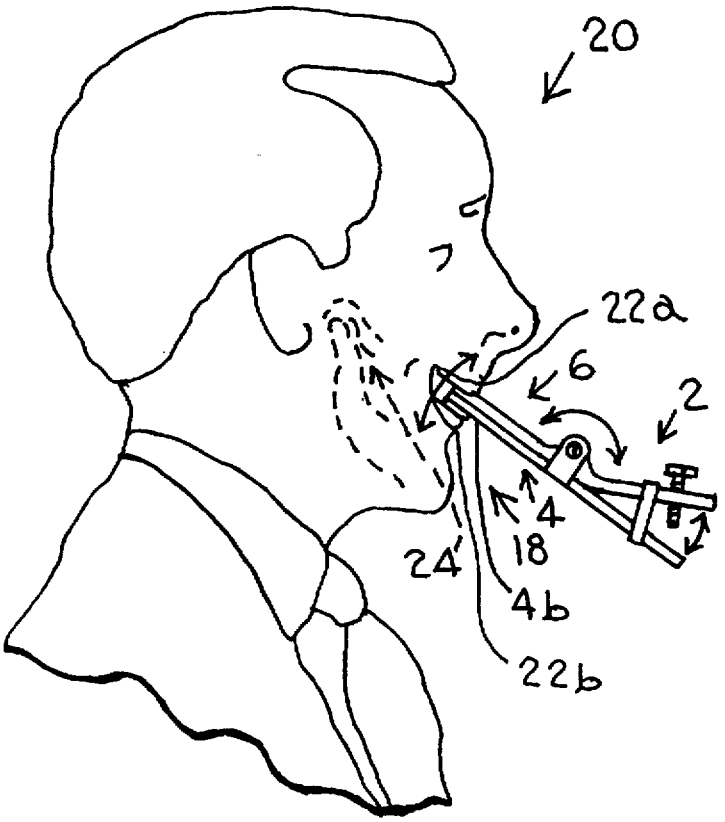
FIG. 4 is an isometric view, partly schematic, illustrating the use of the temporomandibular rehabilitator shown in FIGS. 1–3.

Reference is now made to FIG. 4, in which is illustrated the method of using the temporomandibular rehabilitator 2. The open first ends 6b and 4b of the upper and lower members 6 and 4 are pressed together using the fingers, thereby closing the first ends 6b and 4b to permit insertion thereof in the mouth 18 of a user 20. The teeth 22a and 22b close against the first and second strips 16 and 14. Once the teeth 22a and 22b have bitten into and engaged the strips 16 and 14, the ends 6b and 4b are slowly released to allow the elastic member 10 to exert an opening force between the upper 22a and lower 22b teeth. The elastic member 10 assists in opening, thereby stretching, and provides resistance against closing, thereby exercising the jaw muscles (not shown). The elastic force continues to stretch the muscles, causing the upper 22a and lower 22b teeth to open, thus increasing the opening of the jaw joint 24 to the maximum width allowed by the setting of the set screw 12, which is completely and continuously adjustable. Since resistance is always present, when the user 20 closes the mouth 18 against this resistance, the effect is one of exercising and strengthening the jaw muscles and of relaxing chronically-spasmed muscles. The method comprises first stretching open, then exercising to close against the restraining force; then stretching open again, and biting to close. The cycle is repeated--open and close, open and close, open and close.

Figure 6:
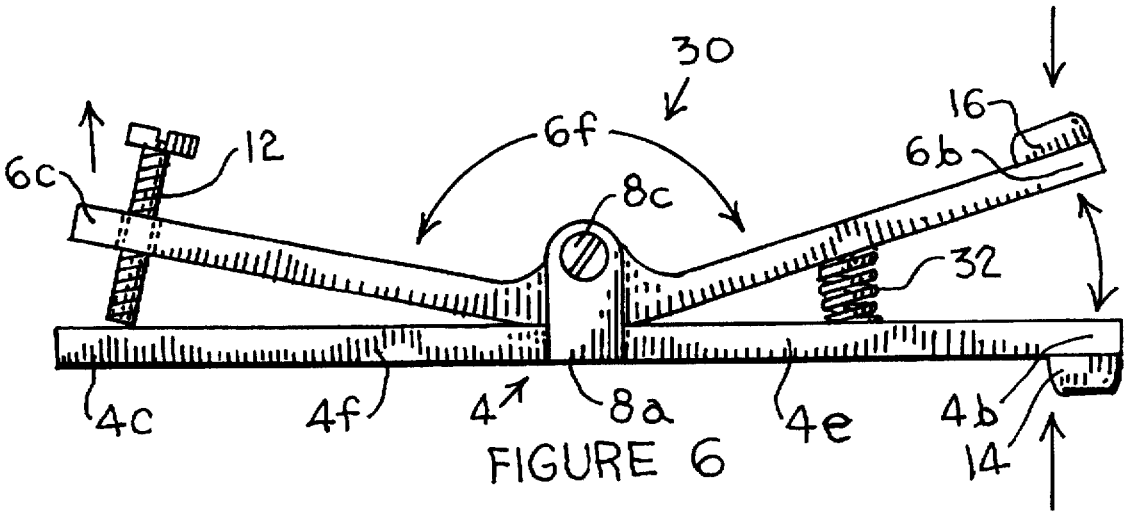
FIG. 6 is an isometric view of a second embodiment of a temporomandibular rehabilitator, made in accordance with the principles of the present invention, in a specific configuration.

Reference is now made to FIG. 6, in which is shown a second embodiment of a temporomandibular rehabilitator, made in accordance with the principles of the present invention, and generally designated by the numeral 30. With the exception of replacing the elastic member 10 of the first embodiment 2 by a compression spring 32, the two embodiments 2 and 30 are identical in structure and usage.

I claim:

1. A temperomandibular rehabilitator, comprising:

(a) a lower planar member having a longitudinal center, first and second ends, and a segment connecting the first and second ends to one another;

(b) an upper angular member having first and second ends, and first and second planar faces defining an obtuse interior angle therebetween, the angular member being pivotally connected at the vertex of the obtuse interior angle to the segment of the planar member which connects the first and second ends thereof to one another, whereby the first planar face of the angular member can be brought into parallel contact with the first end and with a first portion of the segment connecting the first and second ends of the planar member to one another, or the second planar face of the angular member can be brought into parallel contact with the second end and with a second portion of the segment connecting the first and second ends of the planar member to one another;

(c) biasing means for forcing the first planar face of the angular member apart from the first end and first portion of the segment connecting the first and second ends of the planar member to one another; and (d) means for controlling the extent to which the first planar face of the angular member is forced apart from the first end and first portion of the segment connecting the first and second ends of the planar member to one another, said controlling means being a set screw rotatably and perpendicularly disposed in the second planar face of the angular member.

2. The temporomandibular rehabilitator of claim 1, wherein:

(e) the distance separating the first ends of the planar and angular members when the first planar face of the angular member is forced apart from the first end of the planar member is from about forty to about sixty millimeters.

3. The temporomandibular rehabilitator of claim 1, wherein:

(d) the length of the upper and lower members is from about seven inches to about nine inches; and (e) the width of the upper and lower members is from about two and two-tenths inches to about two and six-tenths inches.

* * * * *